US005308925A

United States Patent [19]

Paterek et al.

[11] Patent Number: 5,308,925

[45] Date of Patent: May 3, 1994

[54] CONDUCTIVE PIN ASSEMBLY FOR A MACHINE HOUSING

[75] Inventors: F. Dieter Paterek, Hamilton; Martin S. Russell, Butler County, both of Ohio

[73] Assignee: Emerson Electric Co., St. Louis, Mo.

[21] Appl. No.: 904,946

[22] Filed: Jun. 26, 1992

[51] Int. Cl.[5] ..... H01B 17/30

[52] U.S. Cl. ..... 174/152 GM; 174/50.61; 174/50.56; 174/151

[58] Field of Search ..... 174/152 GM, 18, 50.61, 174/50.56, 50.62, 50.52, 151, 152 R, 152 E, 152 S; 439/736

[56] References Cited

U.S. PATENT DOCUMENTS

| | | | |
|---|---|---|---|
| 2,768,231 | 10/1956 | Schwennesen et al. | 174/18 |
| 3,721,943 | 3/1973 | Curr . | |
| 3,979,187 | 9/1976 | Scherer | 174/152 GM X |
| 4,584,433 | 4/1986 | Bowsky et al. | 174/152 GM |
| 4,840,585 | 6/1989 | Muzslay | 174/18 X |
| 4,841,101 | 6/1989 | Pollock | 174/152 GM |
| 4,961,018 | 10/1990 | Akhter | 310/87 |
| 5,104,755 | 4/1992 | Taylor et al. | 174/50.61 X |

FOREIGN PATENT DOCUMENTS

| | | | |
|---|---|---|---|
| 748175 | 4/1933 | France | 174/152 GM |
| 51-80618 | 1/1978 | Japan | 174/152 GM |
| 0769452 | 3/1957 | United Kingdom | 174/151 |

*Primary Examiner*—Leo P. Picard
*Assistant Examiner*—Hyung S. Sough
*Attorney, Agent, or Firm*—Polster, Lieder, Woodruff & Lucchesi

[57] ABSTRACT

A conductive pin assembly arrangement for a wall opening of a machine housing including a removable plate in sealed relation to the wall opening, the plate having at least one opening extending therethrough, and a conductive sleeve and pin assembly extending longitudinally through the plate in sealed relation to the plate with one end of the pin in the housing and the opposite end outside the housing.

10 Claims, 1 Drawing Sheet

CONDUCTIVE PIN ASSEMBLY FOR A MACHINE HOUSING

BACKGROUND OF THE INVENTION

The present invention relates to conductor pin assembly arrangements and more particularly to a conductor pin assembly arrangement which can be removably associated readily as part of a housing with electrical connection openings of a walled machine housing, particularly of the semi-hermetic type.

Terminal assemblies which incorporate at least one current carrying electrically connected terminal pin extending in insulated relation through a cup shaped body mounted in turn in sealed relation to a housing wall opening are generally known. The outer segment of the pin is connected to an electrical power source and the confined inner segment of the pin to a machine or motor unit in the housing. Such a hermetic terminal assembly arrangement can be found in a number of U.S. patents, issued to Benjamin Bowsky et al, including U.S. Pat. No. 4,584,433 issued on Apr. 22, 1966, the general arrangement being particularly adapted to hermetically sealed housings for comparatively low horse power rated compressor units (for example, one horse-power). It further is known to support a plurality of electrical conducting pins in spaced apart relation in the same sandwiching cover fused to an electrical casing, such as taught by U.S. Pat. No. 2,768,231, issued to D. O. Schwennesen et al on Oct. 23, 1956 and to mold one or more electrical conducting pins in a glass insert forming part of an electrical casing, such as taught by U.S. Pat. Nos. 3,721,943, issued to M. D. Curr on Mar. 20, 1973 and 4,961,018, issued to P. Akther on Oct. 2, 1990.

In higher horse-power rating demands, it also is known to provide current conductive pins threaded adjacent at least one extremity and bolt head configured at the other extremity, the pin extending through opposed faces of an annular compressible insulated seal, usually rubber. The seal engages in an opening in a machine housing wall and when compressed by the urging of a threaded nut engaging against at least one face of the seal, the compressible seal radially expands to provide tightened sealing engagement with the wall housing opening. This past adjustable arrangement has been comparatively expensive with sealing problems arising due to thermal changes and possible compressible material distortions with non-uniform radial expansion of the compressible seal.

More recently in U.S. patent application Ser. No. 07/698,954, filed May 13, 1991, in the name of F. Dieter Paterek, a novel conductive pin terminal assembly arrangement is provided which can be inserted as a complete unit including glass to metal seals within a machine unit housing wall portion to provide a positive, uniform hermetic seal with the wall housing panel. This inventive unit provides for ready removal of the complete terminal assembly unit by providing an internally threaded wall opening engageable by an externally threaded sleeve forming part of the terminal assembly unit.

The present invention provides a further unique and novel conductive pin assembly which also is straightforward and economical to manufacture and assemble and which can be even more readily inserted as a complete unit including sealing means within a unit housing wall portion to provide a positive uniform seal with the housing wall panel without requiring comparatively costly internal and external threading.

Various other features of the present invention will become obvious to one skilled in the art upon reading the disclosure set forth herein.

BRIEF SUMMARY OF THE INVENTION

More particularly the present invention provides a conductive pin assembly arrangement for a wall opening of a machine housing comprising: a flat sheet sized and configured to engage in removably sealing relation along the peripheral edges of the wall opening in the housing to form a part of the wall; and, at least one current conductive pin assembly extending longitudinally through the flat sheet with the peripheral surface of the assembly being in sealed relation to the flat sheet. The present invention further provides a modified pin assembly which includes a sleeve member having inner,.and outer peripheral surfaces with the outer surface sized to moldably engage with the peripheral surface of the opening in the sheet; a current conductive pin extending longitudinally through the sleeve in spaced relation to the inner peripheral surface thereof; a first sealing means cooperatively disposed between the current conducting pin and the inner peripheral surface of the sleeve to seal the pin in the sleeve; and, a second sealing means including a preselected insulated moldable material cooperatively disposed between the outer peripheral sleeve surface and the inner peripheral surface of the pin opening to seal the snugly engaging sleeve thereto.

It is to be understood that various changes can be made by one skilled in the art in one or more of the structure disclosed herein without departing from the scope or spirit of the present invention.

BRIEF DESCRIPTION OF THE DRAWINGS

Referring to the drawings which disclose one embodiment of the present invention and a modification thereof.

DETAILED DESCRIPTION OF THE INVENTION

Figure 2:
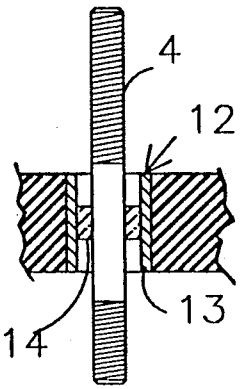
FIG. 2 is a cross-sectional view of one pin assembly of the structural arrangement of FIG. 1 taken in a plane through line 2—2 of FIG. 1.
Figure 1:
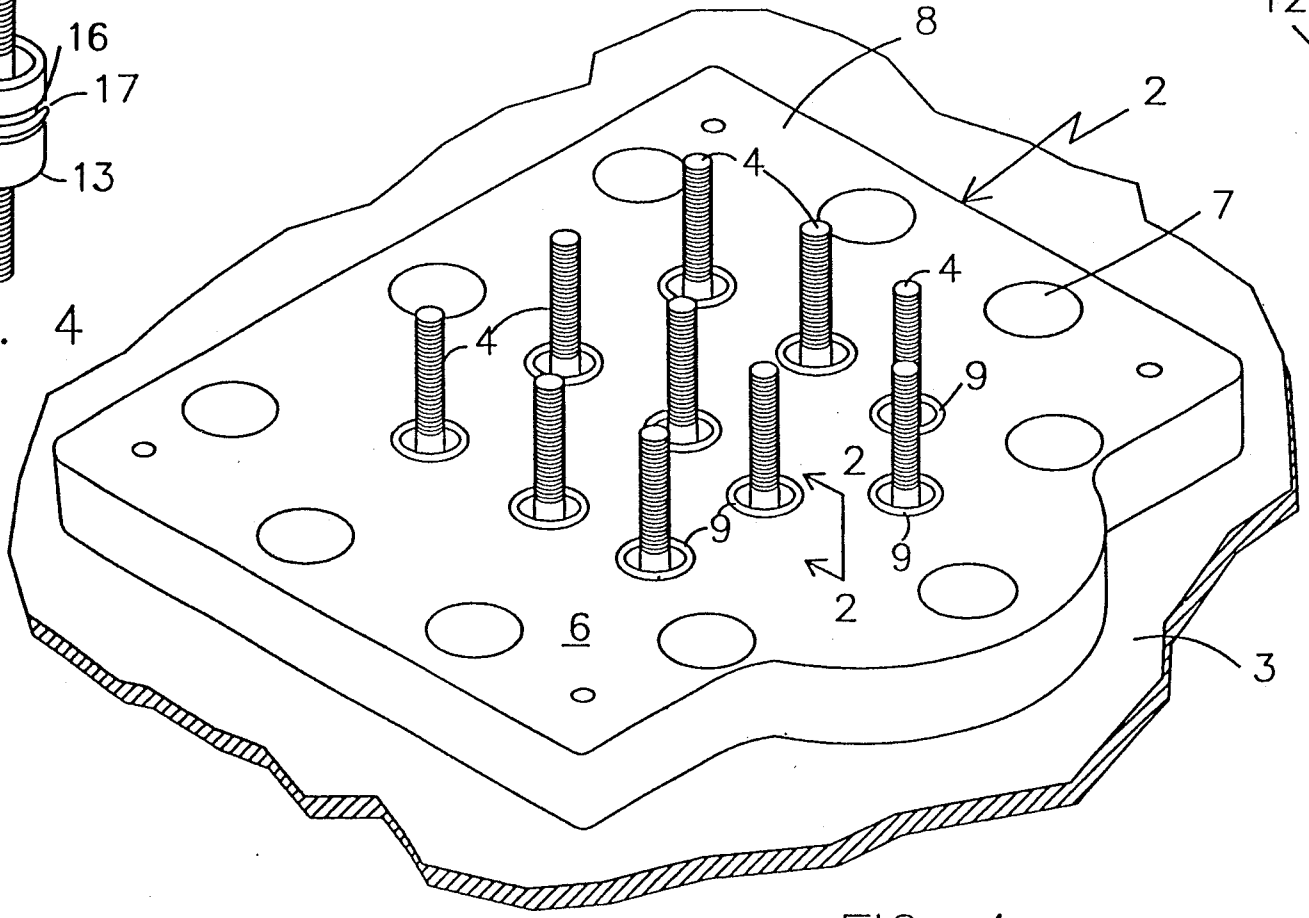
FIG. 1 is an isometric projection of an advantageous embodiment of the present invention disclosing a plurality of spaced electrical conductive pin assemblies sealed in a sheet mounted in seated relation with the peripheral edges of an opening in a wall portion of a machine housing, each pin assembly including an electrically conductive pin, a spaced surrounding sleeve and a sealing member disposed between the pin and sleeve.

As can be seen in FIGS. 1 and 2 of the drawings, a conductive pin assembly arrangement 2 for a pin assembly opening which extends through and between opposed faces of a wall portion 3 is disclosed. The pin assembly includes a plurality of suitably spaced pins 4 which are sealed in sheet 6. Pins 4 can be made from any one of a number of suitably electrically conductive materials, such as a 446 copper cored stainless steel, and in the embodiment, disclosed can be male threaded at least at opposed ends to accommodate appropriately sized, internally female threaded electrical connectors. The sheet 6 can be any one of a number of electrically insulative moldable plastic material so that pins 4 with the assemblies described hereinafter can be appropriately and easily installed into the sheet. Sheet 6, which can be sized and configured to overlap with the peripheral edges of an opening in wall portion 3 is provided with suitably sized and spaced peripheral openings 7 to permit fastening to wall portion 4 along with the peripheral edges thereof, usually in a semi-hermetically sealed relationship therewith. It is desirable that the sheet 6 be of suitable general properties compatible as to the coefficients of expansion with the housing and pins to be associated therewith. Advantageously, moldable plastic with a compatible coefficient of expansion has been found to be suitable. It is to be understood, of course, that the moldable plastic selected can be varied in accordance with the environment in which the novel pin assembly arrangement is to be employed. In this regard, it also is to be understood that the spacing of the electrically conductive pins 4 in the sheet 6 also can be varied in accordance with the electric current potential to be transmitted through the conductive pins.

Figure 3:
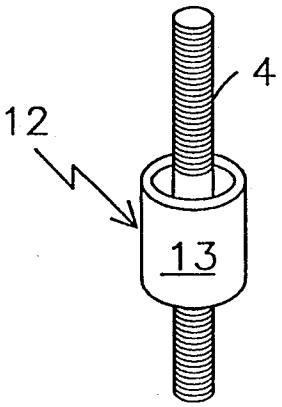
FIG. 3 is an isometric projection of one of the pin assemblies of FIG. 1 showing an electrically conductive pin sealed in spaced relation to a sleeve which in turn is to be sealed in a flat sheet like that of FIG. 1; and, FIG. 4 is a sectional view similar to FIG. 3 of a modified pin assembly disclosing a further sealing member associated with the sleeve.

In the embodiment of the present invention, an electrically insulative or non-conductive sheet can be provided which, like the moldable plastic material above described, should have suitable general properties compatible with the housing and pins to be associated therewith. A suitable ceramic for a known environmental surrounding has been found to be a ceramic material sold by MyKroy/Mycalex Ceramics of Clinton, N.J., designated with the molding grade 620/1301. Non-conductive sheet 6 is formed with a plurality of pin openings 9 extending therethrough. Openings 9 are laterally spaced from each other a preselected distance to minimize arcing of the pins 11 disposed therein. Pins 4, can be formed from any one of a number of suitable materials, preselected to fit the environmental conditions in which they are to be used and the current potential to be carried to pins 4 of FIGS. 1 and 2. As can be seen in FIGS. 2 and 3 particularly, pins 4 are each part of a pin assembly 12 which includes a spaced, cylindrical preformed unitary sleeve 13 having inner and outer peripheral surfaces with the outer peripheral surface being sized to snugly engage with the peripheral surface of the associated pin opening 9 extending through ceramic sheet 6. Each sleeve 13 can be formed from a suitably selected mild steel with pins 4, sheet 6 and sleeve 13 having compatible coefficients of expansion. An appropriately selected glass seal 14, having a comparatively high coefficient of expansion to insure higher compressibility and better sealing during temperature rises which sealing advantageously can be one of several types of glass generally known in the art, is disposed between each current conducting pin 4 and the inner peripheral surface of an associated sleeve 13 to seal the pin in the sleeve. It is to be understood that appropriate fixturing and jig members can be readily utilized to form the pin assemblies 12 in an efficient assembling operation. Once the pin assemblies 12 have been appropriately completed they are then each snugly inserted and sealed in an opening 9. Advantageously, a preselected locking glue seal can be cooperatively disposed between the outer peripheral surface of each sleeve 13 and the peripheral surface of the pin opening 9 to seal the snugly engaging sleeve 13 in locked position. Although any one of several known sealing materials can be used to lock sleeve 13 into opening 9, a suitable locking glue referred to by the Locktite Corporation of Newington, Conn. as Formula No. 620 has been found to be compatible with refrigeration compressor housings where the unique and novel arrangement could be employed.

Figure 4:
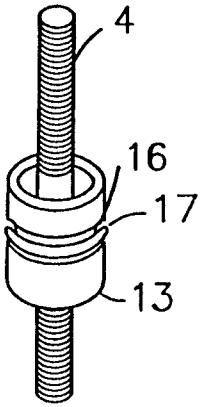

Referring to FIG. 4 of the drawings a further modification is disclosed, wherein sleeve 13 is provided with a peripheral recess 16 which recess serves to receive an O-ring 17, therein advantageously of an elastic material such as rubber. This O-ring 17 serves to improve the sealing between sheet 6 and sleeve 13 extending beyond the peripheral surface of sleeve 13.

The invention claimed is:

1. A conductive pin assembly arrangement for a wall opening of a machine housing comprising: a sheet having at least one pin opening extending therethrough; said sheet being sized, shaped and configured for engaging in removably sealing relation along the peripheral edges of said wall opening in said housing to conform with and form a part of a machine housing wall defining said wall opening;

a preformed unitary sleeve member including inner and outer peripheral surfaces, said outer peripheral sleeve surface being sized to conform with and engage along the peripheral surface of said pin opening extending through said sheet;

a current conductive pin extending longitudinally through said sleeve in spaced relation to the inner peripheral surface thereof;

a first sealing means of preselected glass material cooperatively disposed between said current conducting pin and said inner peripheral surface of said sleeve to seal said pin in said sleeve; and, a second sealing means including a preselected insulated moldable material cooperatively disposed between said outer peripheral sleeve surface and the inner peripheral surface of said pin opening to mold and seal said engaging unitary sleeve thereto.

2. The conductive pin assembly arrangement of claim 1, said entire sheet being a preselected insulated moldable plastic material having said pin sleeve molded therein.

3. The conductive pin assembly arrangement of claim 1, said first sealing means having a comparatively high preselected coefficient of expansion in accordance with anticipated temperature rises to ensure sealing over such temperature rises.

4. The conductive pin assembly arrangement of claim 1, said entire sheet being electrically insulated non-conductive sheet of preselected moldable ceramic material.

5. The conductive pin assembly arrangement of claim 1, said sleeve and pin each being a mild steel with compatible coefficients of thermal expansion.

6. The conductive pin assembly arrangement of claim 1, said second sealing means being a preselected self-hardening adhesion.

7. The conductive pin assembly arrangement of claim 1, said sleeve having a further sealing member cooperative between said sleeve and the sheet.

8. The conductive pin assembly arrangement of claim 7, said sleeve having a recess to receive said member.

9. The conductive pin assembly of claim 8, said recess extending around the periphery of said sleeve intermediate the extremities, said sealing member being an O-ring engaging in said recess 40 extend beyond the peripheral surface of said sleeve.

10. A conductive pin assembly arrangement for a wall opening of a semi-hermetically sealed housing comprising;

an electrically insulated substantially flat sheet of moldable ceramic material having a plurality of pin openings extending therethrough laterally spaced from each other a preselected distance to minimize arcing of pins disposed therein;

a plurality of mild steel preformed unitary sleeve members, one for each of said openings, each sleeve member including inner and outer peripheral surfaces with the outer peripheral surface being sized in length to approximate the thickness of said sheet to snugly engage with the entirety of said peripheral surface of said pin opening extending through said moldable ceramic sheet, a current conductive pin for each sleeve, said pin extending longitudinally through said associated sleeve in spaced relation to the inner peripheral surface thereof, said pins, sleeves and ceramic having compatible coefficients of expansion; and, a glass seal cooperatively disposed between each current conducting pin and the inner peripheral surface of said sleeve to seal said pin in said sleeve, said glass seal having a comparatively high preselected coefficient of expansion in accordance with anticipated temperature rises to insure sealing over such temperature rises; and a locking seal cooperatively disposed between the outer peripheral sleeve surface of each sleeve and the peripheral surface of the pin opening to seal said snugly engaging sleeve in locked position.

* * * * *

UNITED STATES PATENT AND TRADEMARK OFFICE

CERTIFICATE OF CORRECTION

PATENT NO. : 5,308,925

DATED : May 3, 1994

INVENTOR(S) : F. Dieter Paterek et al

It is certified that error appears in the above-indentified patent and that said Letters Patent is hereby corrected as shown below:

Column 2, lines 27 and 28 delete "including a preselected insulated moldable material"

Column 3, line 5, after "of", second occurrence, insert —suitable materials and advantageously can be a preselected—

Column 4, line 58, delete "adhesion" and insert —adhesive— line 67, delete "40" and insert —to—

Signed and Sealed this

Thirteenth Day of September, 1994

*Attest:*

*Attesting Officer*

BRUCE LEHMAN

*Commissioner of Patents and Trademarks*